US011635254B2

(12) United States Patent
Zhao et al.

(10) Patent No.: US 11,635,254 B2
(45) Date of Patent: Apr. 25, 2023

(54) UTILIZATION OF NITROGEN-ENRICHED STREAMS PRODUCED IN AIR SEPARATION UNITS COMPRISING SPLIT-CORE MAIN HEAT EXCHANGERS

(71) Applicants: L'Air Liquide, Societe Anonyme pour l'Etude et l'Exploitation des Procedes Georges Claude, Paris (FR); Bowei Zhao, Hangzhou (CN); Alain Briglia, Hangzhou (CN)

(72) Inventors: Bowei Zhao, Hangzhou (CN); Alain Briglia, Hangzhou (CN)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 166 days.

(21) Appl. No.: 16/958,286

(22) PCT Filed: Dec. 28, 2017

(86) PCT No.: PCT/CN2017/119235
§ 371 (c)(1),
(2) Date: Jun. 26, 2020

(87) PCT Pub. No.: WO2019/127179
PCT Pub. Date: Jul. 4, 2019

(65) Prior Publication Data
US 2021/0055049 A1 Feb. 25, 2021

(51) Int. Cl.
*F25J 3/04* (2006.01)

(52) U.S. Cl.
CPC ..... *F25J 3/0409* (2013.01); *F25J 3/04151* (2013.01); *F25J 3/04157* (2013.01);
(Continued)

(58) Field of Classification Search
CPC .. F25J 3/04157; F25J 3/04151; F25J 3/04775; F25J 3/04218; F25J 3/04169;
(Continued)

(56) References Cited

U.S. PATENT DOCUMENTS

| | | | |
|---|---|---|---|
| 3,447,332 | A | 6/1969 | Basin et al. |
| 6,196,024 | B1 | 3/2001 | Ha |
| 6,430,962 | B2 | 8/2002 | Miura et al. |
| 7,546,748 | B2 | 6/2009 | Judas |

(Continued)

FOREIGN PATENT DOCUMENTS

| | | |
|---|---|---|
| CN | 1 310 323 | 8/2001 |
| CN | 101 103 240 | 1/2008 |

(Continued)

OTHER PUBLICATIONS

International Search Report and Written Report for PCT/CN2017/119235, dated Aug. 30, 2018.
EP Search Report for EP 17936214, dated Jul. 3, 2021.

*Primary Examiner* — John F Pettitt, III
(74) *Attorney, Agent, or Firm* — Justin K. Murray

(57) ABSTRACT

An air separation apparatus and process, which produces gaseous oxygen and/or nitrogen products at an elevated pressure through internal compression of respective liquid products, are disclosed. Split-core main heat exchangers are employed to warm up product streams generated in an air rectification unit against 1) a main feed air stream in the low-pressure heat exchanger and 2) at least one boosted pressure air stream in the high-pressure exchanger. Because the boosted pressure air stream is at a higher pressure and temperature than the main feed air stream, after separate heat exchange in the split main heat exchangers, the subsidiary waste nitrogen stream exiting the high-pressure heat exchanger is also warmer than the subsidiary waste nitrogen stream exiting the low-pressure heat exchanger. The warmer waste nitrogen stream is fed into the air purification unit for regeneration purposes and the cooler waste nitrogen stream
(Continued)

is introduced into the nitrogen water tower to perform cooling duty. The two subsidiary waste nitrogen streams are also connected on the warm side of the main heat exchangers to allow flexible distribution of the flow.

15 Claims, 1 Drawing Sheet

(52) U.S. Cl.
CPC ..... *F25J 3/04169* (2013.01); *F25J 3/04181* (2013.01); *F25J 3/04218* (2013.01); *F25J 3/04412* (2013.01); *F25J 3/04296* (2013.01); *F25J 3/04775* (2013.01); *F25J 2205/32* (2013.01); *F25J 2240/10* (2013.01); *F25J 2245/42* (2013.01)

(58) Field of Classification Search
CPC .... F25J 3/04412; F25J 2205/32; F25J 3/0409; F25J 3/04181; F25J 3/04296
See application file for complete search history.

(56) References Cited

U.S. PATENT DOCUMENTS

| | | | | |
|---|---|---|---|---|
| 9,222,725 | B2 | 12/2015 | Prosser et al. | |
| 2001/0015069 | A1 | 8/2001 | Miura et al. | |
| 2007/0209389 | A1 | 9/2007 | Prosser | |
| 2011/0192194 | A1* | 8/2011 | Howard | F25J 3/042 62/648 |
| 2015/0253075 | A1 | 9/2015 | Davidian et al. | |
| 2018/0073804 | A1 | 3/2018 | Allam | |
| 2018/0347900 | A1* | 12/2018 | Golubev | F25J 3/04084 |

FOREIGN PATENT DOCUMENTS

| | | |
|---|---|---|
| CN | 101 324 395 | 12/2008 |
| CN | 105 431 698 | 3/2016 |
| DE | 101 15 258 | 7/2002 |
| DE | 10 2011 113262 | 3/2013 |
| DE | 10 2011 113671 | 3/2013 |
| EP | 2 662 654 | 11/2013 |
| WO | WO 2012/155318 | 11/2012 |
| WO | WO 2014 053297 | 4/2014 |

* cited by examiner

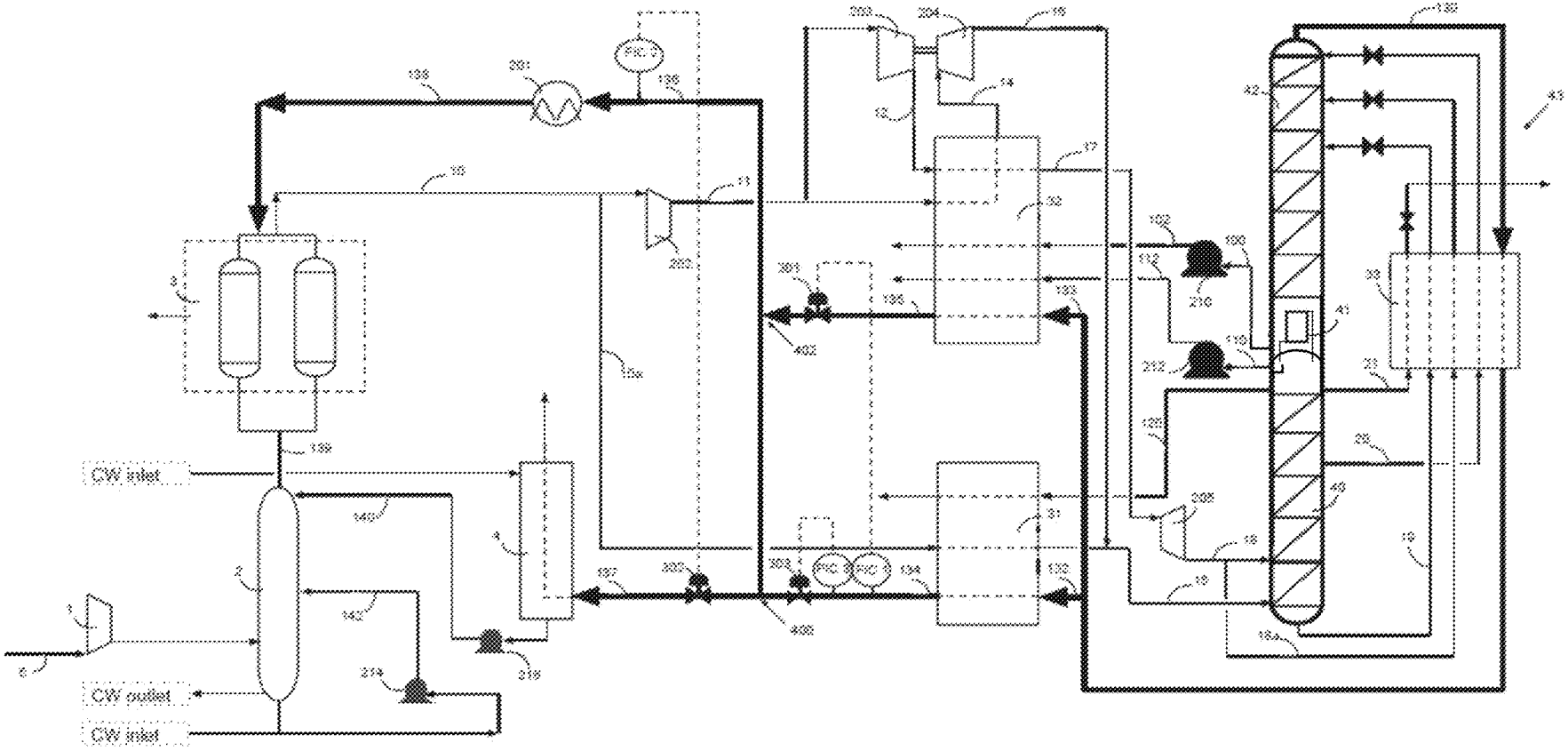
CW inlet
CW outlet
CW inlet

UTILIZATION OF NITROGEN-ENRICHED STREAMS PRODUCED IN AIR SEPARATION UNITS COMPRISING SPLIT-CORE MAIN HEAT EXCHANGERS

CROSS REFERENCE TO RELATED APPLICATIONS

This application is a § 371 of International PCT Application PCT/CN2017/119235, filed Dec. 28, 2017, which is herein incorporated by reference in its entirety.

FIELD OF THE INVENTION

The present invention relates to a method and an apparatus for separating air into nitrogen and oxygen-rich products by cryogenic distillation. More particularly, it relates to the production of gaseous oxygen product at elevated pressure through indirect heat exchange between a pumped oxygen liquid and a feed air stream that has been compressed by both a main air compressor and a booster air compressor.

BACKGROUND OF THE INVENTION

Cryogenic air distillation is a well-established and preferred method for producing large scale oxygen, nitrogen or sometime rare gas products from air.

In cryogenic air distillation, air is compressed and then purified of higher boiling contaminants such as carbon dioxide, moisture and hydrocarbons. The resulting compressed and purified air stream can be cooled within a main heat exchanger against return streams to a temperature suitable for its rectification and then fed into an air rectification unit (ASU). An ASU usually comprises a higher pressure column (operated around 5~6.5 bara) and a lower pressure column (operated around 1.1~1.5 bara), which are thermally linked by a condenser-evaporator disposed near the bottom of the lower pressure column. Within the higher pressure column, the feed air is rectified to form an oxygen-enriched liquid stream near the bottom and nitrogen-enriched streams of various purities at different distillation plate, part or all of these streams can be subcooled and then introduced into the lower pressure column as reflux or for further refinement. Depending on customer's needs, an ASU of double columns can produce gaseous or liquid nitrogen product streams at the top of either the higher pressure or the lower pressure column, gaseous or liquid oxygen product streams at the bottom of the lower pressure column and/or a waste nitrogen stream below the top of the lower pressure columns. The product streams and the waste nitrogen stream are introduced into the main heat exchanger as return streams to cool the incoming air streams.

In a typical double column distillation scheme, the oxygen product streams are withdrawn at the bottom of the lower pressure column operating at 1.1~1.5 bara. To produce gaseous oxygen product at elevated pressure from about 20 to 50 bar, the oxygen must be compressed to higher pressure either by oxygen compressor or by the liquid pumped process. Because of the safety and cost issues associated with the oxygen compressors, the liquid pumped process becomes more common in ASUs. In the later process, a liquid oxygen product stream is pumped to the desired pressure followed by being introduced into and vaporized in the main heat exchanger against a stream of the compressed and purified air that has been further compressed by a booster compressor. The boosted pressure stream of air in turn either liquefies or is converted into a dense phase fluid in this heat exchanging process. Additionally, gaseous nitrogen product at elevated pressure can be produced by pumping liquid nitrogen product stream and then vaporizing it in a main heat exchanger in a like manner.

Although in the above liquid pumped process, a single, main heat exchanger can be used for cooling the incoming air streams through indirect heat exchange with all the return streams regardless of their pressure, it is also known to vaporize the pressurized liquid oxygen product stream within a separate higher pressure heat exchanger to improve overall cost efficiency. For thermal balancing purposes, nitrogen-enriched streams, after having been used in subcooling duty, is divided and fed into both the higher pressure heat exchanger and the lower pressure heat exchanger that cool the main air stream to a temperature suitable for its rectification.

At the warm end of the higher pressure heat exchanger and the lower pressure heat exchanger, the exiting nitrogen-enriched (or waste nitrogen) streams often have different pressure and/or temperature. Since the warmed nitrogen-enriched (or waste nitrogen) streams can be further used to regenerate the adsorbent in an air purification unit or in a pre-cooling unit, considerations are given to the quantity, temperature and pressure of each subsidiary nitrogen-enriched stream before arranging its respective function.

U.S. Pat. No. 9,222,725B2 discloses an air separation apparatus and method wherein both a higher pressure heat exchanger and a lower pressure heat exchanger are employed. In order to reduce the fabrication costs of the higher pressure heat exchanger by decreasing its size, a first subsidiary waste nitrogen stream goes through a smaller cross-sectional flow area within the higher pressure heat exchanger and undergoes a higher pressure drop in comparison to a second subsidiary waste nitrogen stream passing through the lower pressure heat exchanger. Because the second subsidiary waste nitrogen stream is at a higher pressure, it is sent to the air purification unit for regenerating the adsorbent.

In US 2001/0015069 A1, a separate higher pressure heat exchanger is also employed to vaporize pumped liquid oxygen product. A product nitrogen stream taken out from the top of the lower pressure column is divided into two subsidiary streams, which are led into the higher pressure heat exchanger and the lower pressure heat exchanger, respectively. The subsidiary product nitrogen stream exiting the higher pressure heater exchanger is then used for regenerating the adsorbent in the air purification unit. The subsidiary product nitrogen stream exiting the lower pressure heater exchanger is not used in the pre-cooling unit and the two subsidiary product nitrogen streams are not interconnected on the warm side of the heat exchangers.

U.S. Pat. No. 3,447,332 describes a nitrogen stream taken out of a rectification column being divided into two streams before going through two separate main heat exchangers. In a low pressure heat exchanger, a first subsidiary nitrogen stream, along with a pressurized liquid oxygen stream, warm up against a first stream of compressed and purified air; while in a high pressure heat exchanger, a second subsidiary nitrogen stream undergoes indirect heat exchange against a second and a third stream of compressed and purified air. The first, second and third streams of compressed and purified air are divided from the same stream of compressed and purified air out of the adsorber, thus they all have the same temperature and pressure at the warm-end entrance of the two main heat exchangers. The warmed first subsidiary nitrogen stream is led into the adsorber for regeneration purpose and the second subsidiary nitrogen stream is introduced into the precooler. The two warmed subsidiary nitrogen streams are not in flow communication.

SUMMARY OF THE INVENTION

Improving energy efficiency and reducing cost associated with raw material and equipment constantly challenge persons in the field of cryogenic air separation.

Once nitrogen-rich streams are warmed up in a higher pressure heat exchanger and a lower pressure heater exchanger, respectively, they can be further used to cool water in an air pre-cooling unit comprising a nitrogen water tower or to regenerate adsorbent in an air purification unit. Since temperature required for regeneration is higher than that for pre-cooling, warmed nitrogen-rich streams of a higher temperature shall be transported thereto for energy-saving purposes. Additionally, having adequate flow of warmed nitrogen-rich stream to the air purification unit is critical for the operation of the entire air separation apparatus, thus a mechanism is needed to maintain the flow consistency. The above-cited references do not take into consideration of overall energy efficiency and do not provide a means for adjusting the flow of nitrogen-rich stream introduced into the air purification unit.

Accordingly, certain embodiments of the present invention provide a process of separating air, which comprises the following steps. Firstly, pass a feed air stream sequentially through a main air compressor, an air pre-cooling unit and an air purification unit to produce a main feed air stream, which is then divided into two parts. A first part of the main feed air stream is further compressed in a booster air compressor to form a boosted pressure air stream having a higher pressure and a higher temperature than the main feed air stream. Cool the remaining part of the main feed air stream in a low pressure heat exchanger through indirect heat exchange with a first nitrogen-enriched stream produced in an air rectification unit comprising a first column, a second column and a condenser evaporator disposed at the bottom of the second column, thereby producing a first feed air stream for feeding into the air rectification unit. The boosted pressure air stream is also divided into two parts, a first part is partially cooled in a high pressure heat exchanger through indirect heat exchange with a pumped oxygen liquid and a second nitrogen-enriched stream produced in the air rectification unit, followed by expansion in a first expander before feeding into the air rectification unit as a second feed air stream, and optionally compress the remaining part of the boosted pressure air stream in a first compressor before cooling it in the high pressure heat exchanger through indirect heat exchange with the pumped oxygen liquid and the second nitrogen-enriched stream to produce a third feed air stream, followed by expansion in a second expander to produce an expanded third feed air stream for feeding into the air rectification unit. At the high-temperature side of the heat exchangers, a warmed second nitrogen-enriched stream formed after passing the second nitrogen-enriched stream through the high pressure heat exchanger is introduced into a regeneration gas heater and the air purification unit for regeneration and a warmed first nitrogen-enriched stream formed after passing the first nitrogen-enriched stream through the low pressure heat exchanger is led into a further entity; wherein the warmed first and the warmed second nitrogen-enriched streams are in flow communication and the warmed second nitrogen-enriched stream is of a higher temperature compared to the warmed first nitrogen-enriched stream.

In the air rectification unit, the first column is operated at a higher pressure than the second column. Therefore, the first column is sometimes referred to as the high pressure column and the second column the low pressure column.

The present invention also discloses an air separation apparatus comprising a main air compressor and an air pre-cooling unit in flow communication with an air purification unit to produce a main feed air stream; a booster air compressor in flow communication with the air purification unit to further compress part of the main feed air stream to form a boosted pressure air stream having a higher pressure and a higher temperature than the main feed air stream; a split low pressure heat exchanger and a high pressure heat exchanger. It also comprises an air rectification unit comprising a first column, a second column and a condenser evaporator disposed at the bottom of the second column to produce a first and a second nitrogen-enriched stream and an oxygen liquid. In this apparatus, the low pressure heat exchanger is configured to receive and cool part of the main feed air stream through indirect heat exchange with the first nitrogen-enriched stream to form a first feed air stream and a warmed first nitrogen-enriched stream. There is also a first expander in flow communication with the booster air compressor to expand at least part of the boosted pressure air stream after said stream is partially cooled within the high pressure heat exchanger through indirect heat exchange with the second nitrogen-enriched stream and a pumped oxygen liquid to form a second feed air stream to be introduced into the air rectification unit, a warmed second nitrogen-enriched stream and a gaseous oxygen product. In the apparatus, the high pressure heat exchanger is configured to receive and cool part of the boosted pressure air stream after said stream is optionally compressed by a first compressor through indirect heat exchange with the second nitrogen-enriched stream and a pumped oxygen liquid to form a third feed air stream to be introduced into the air rectification unit after expansion via a second expander. There are also a first conduit for transporting the warmed first nitrogen-enriched stream from the low pressure heat exchanger to a further entity and a second conduit for transporting the warmed second nitrogen-enriched stream from the high pressure heat exchanger to the air purification unit; wherein the first conduit and the second conduit are interconnected through a conjoint section to allow at least part of the warmed first nitrogen-enriched stream or the warmed second nitrogen-enriched stream to flow through the conjoint section.

The further entity of the current disclosure may be a nitrogen water tower of an air pre-cooling unit.

The first and the second nitrogen-enriched streams are divided from a same nitrogen-enriched gaseous stream withdrawn from the second column.

The flow balance of the warmed first nitrogen-enriched stream to the warmed second nitrogen-enriched stream is regulated by two valves strategically placed along the first conduit and the second conduit.

Because the boosted pressure air stream entering the high pressure heat exchanger is at both a higher temperature and a higher pressure than the main feed air stream, due to thermal load balance, after respective indirect heat-exchange, the warmed second nitrogen-enriched stream is also at a higher temperature than the warmed first nitrogen-enriched stream. Introducing the warmer nitrogen-enriched stream to the regeneration gas heater for the air purification unit can save heating energy, in turn improves energy efficiency of the overall apparatus. Moreover, since the warmed second nitrogen-enriched stream and the warmed first nitrogen-enriched stream are in flow communication, the later stream can supplement the former stream to ensure an adequate flow is always available for the air purification unit.

Through optimized distribution of nitrogen-enriched streams produced in an air rectification unit between an air pre-cooling unit and an air purification unit according to the present disclosure, the following advantages are obtained:

a) The nitrogen-enriched stream of a lower temperature helps to cool the feed air stream to a lower temperature in the air pre-cooling unit; thus saves energy and reduces the size of the pre-cooling unit, which in turn decreases the equipment expenditure.
b) The feed air stream entering the air purification unit is at a lower temperature, as a result, the water content in the feed air stream is lower leading to smaller adsorbent volume and adsorber size, which in turn decreases the equipment expenditure.
c) The nitrogen-enriched stream of a higher temperature requires less energy to be heated to the suitable temperature by the regeneration gas heater for regenerating the adsorbents.
d) Booster air compressor consumes less power when the temperature of the inlet gas is lower.
e) On the warm side of the main heat exchangers, strategic placement of the valves allows flexible distribution of the warmed nitrogen-enriched streams. For instance, before the high pressure heat exchanger is in operation, nitrogen-enriched stream exiting the low pressure heat exchanger can be introduced into the air purification unit for regenerating the adsorbent, thus expediting the start-up process of the air rectification unit.
f) The present invention also discloses a mechanism through which the operation pressure of the entire rectification unit can be raised to produce gaseous streams at a higher pressure at customer's request.

BRIEF DESCRIPTION OF THE DRAWINGS

The accompanying drawing is to be understood as exemplary of the present invention, and does not in any way limit the scope thereof.

The FIGURE is a schematic illustration of an air separation apparatus for carrying out a method in accordance with the present invention.

DETAILED DESCRIPTION OF THE INVENTION

A cryogenic air separation plant generally comprises the following units: a main air compressor with filter, an air pre-cooling unit, an air purification unit and an air rectification unit housed in a single or multiple cold boxes.

Atmospheric feed air stream passes through a series of inlet filter installed at the suction side of a main air compressor to remove the dust particles. The main air compressor may be of a centrifugal type with several stages. During compression in the main air compressor, the temperature of the filtered feed air stream rises up to about 70~95° C., thus it needs to be cooled to a temperature suitable for entering the air purification unit. Cooling can be achieved in several ways. After exiting the main air compressor, the feed air stream can pass through an aftercooler first or enter directly into an air pre-cooling unit. An air-precooling unit consists of apparatus that cools incoming air against chilled cooling water and apparatus for chilling cooling water. The air-cooling apparatus may be a one-stage direct contact air cooler (DCAC), a two-stage DCAC or a tabular exchanger. In one-stage DCAC, air enters from the bottom and undergoes counter current contact with chilled cooling water pumped to the top. In two-stage DCAC, air also enters from the bottom and is in counter current contact firstly with normal cooling water brought to the mid-to-lower section of the cooler and secondly with chilled cooling water pumped to the upper section of the cooler. Chilled cooling water is generally obtained in a nitrogen water tower through evaporating some cooling water during counter current contact with dry nitrogen-enriched streams (commonly waste nitrogen stream) produced in the air rectification unit. The vaporized water absorbs the latent heat from the dry nitrogen-enriched streams and cools the nitrogen-stream, which in turn chills the remaining cooling water to around 10~20° C. A refrigeration unit can also be employed to chill the cooling water to around 5~10° C. Since the nitrogen-enriched stream is a primary cooling source in the air pre-cooling unit, its properties significantly impact the energy efficiency/power consumption of the unit and the exiting temperature of the feed air stream. The lower temperature of the incoming nitrogen-enriched stream leads to a colder feed air stream obtained in the pre-cooling unit.

An air purification unit is essential in removing water, $CO_2$ and hydrocarbons from the feed air stream before air gets cooled down to cryogenic temperature in the heat exchangers. If the air is not purified, moisture and $CO_2$ will condense and liquid water will freeze as temperature drops in the heat exchanging process, causing plugging in the heat exchangers. Adsorption vessels are standard equipment for purification. The adsorbents are selected based on the type of impurities to be removed and popular choices include coals, silica gel, alumina, zeolites and molecular sieves. In a typical dual-vessel or four-vessel adsorption unit, two layers of adsorbents are placed horizontally in each vessel, at the lower portion is activated alumina for removing water and above are molecular sieves for removing $CO_2$. When air enters from the bottom of the adsorption vessel, it first passes through the alumina bed. Because colder air stream is saturated with lower content of water, the volume of alumina required to treat the same flow of air stream is reduced. The feed air stream then passes through the bed of molecular sieves. Since the adsorption efficiency for $CO_2$ is higher at lower temperature, the volume of molecular sieves needed to treat the same flow of air stream is also decreased. As a result of the above phenomena, fewer adsorbents are needed for treating colder feed air stream, thus the size of the adsorption vessel could be reduced and cost-saving on the whole unit is achieved.

Because adsorbents have a finite capacity for adsorption, they need to be reactivated or regenerated once saturated with impurities. Regeneration of the adsorbents is usually carried out by passing high temperature nitrogen at low pressure into the adsorption vessel from the direction opposite that of the feed air stream. A regeneration gas heater is used to heat the nitrogen-enriched stream leaving the heat exchanger to a temperature range from 120° C.-160° C. To warm nitrogen-enriched stream to a desired temperature, less energy is consumed for a stream of a higher initial temperature, and when the regeneration gas heater is driven by steam, about 10~20% steam can be saved.

In order to produce high-pressure gaseous product, such as oxygen or nitrogen with a pressure above ~40 bara, internal compression process is often performed, where a respective liquid product is first pressurized by a liquid pump to the target pressure, then vaporized in a heat exchanger through indirect heat exchange against pressurized warm streams including air or in some cases nitrogen-enriched gases. Pressurizing air is carried out by further compressing feed air stream exiting the air purification unit in a booster air compressor or a series of booster air compressors. Typically, a single booster air compressor can pressurize a feed air stream from around 5~7 bara after the main air compressor to around 40~60 bara. Because compression is an exothermic process, the feed air stream has to be cooled down in an aftercooler before entering heater exchangers; however, even after cooling, the feed air stream undergoing additional compression is still warmer in comparison to the stream passing only through the main air compressor, and the temperature difference can range from about 2~20° C.

Although a single, main heat exchanger can be utilized for cooling incoming feed air streams at different pressure, for return streams containing pressurized liquid oxygen and/or nitrogen stream, it is known to separately vaporize the pressurized liquid oxygen stream within a separate high pressure heat exchanger through indirect heat exchange with boosted pressure air streams; while warming up gaseous return streams at a lower pressure within a low pressure heat exchanger through indirect heat exchange with the main feed air stream. Because heat exchanger capable of withstanding high pressure (maximum 70~100 bara) is more expensive than heat exchanger designed for low pressure duty (maximum 10~20 bara), such a separated configuration saves fabrication cost for the overall heat exchanging unit. For thermal balancing purpose, a nitrogen-enriched gaseous stream, often waste nitrogen stream removed from the lower pressure column, is divided and fed into the cold sides of both the high pressure heat exchanger and the low pressure heat exchanger. According to the present invention, the warm stream for the high pressure heat exchanger is boosted pressure air stream at both a higher pressure and a higher temperature than the main feed air stream, which is the warm stream for the low pressure heat exchanger. Due to thermal equilibrium in the respective heat exchanger, the nitrogen-enriched gaseous stream passing through the high pressure heat exchanger is warmer than the part of stream that flows through the low pressure heat exchanger. The pressure of the divided nitrogen-enriched gaseous streams at the warm sides of both heat exchangers depends on the built-in pressure drop of the heat exchangers, which is determined by the configuration, such as cross-sectional area of each passage in the heat exchanger.

With reference to FIG. 1, the present invention is illustrated in the following. But it is to be understood that the embodiment is only exemplary and does not limit the scope and application of the invention.

A feed air stream 5 is first compressed in a main air compressor 1 with an aftercooler to a pressure of ~6.0 bara and a temperature of ~100° C. before entering into a two-stage direct contact air cooler (DCAC) of an air pre-cooling unit 2. In the DCAC, the feed air stream rises from the bottom and undergoes counter current contact with first cooling water 142 around 30° C. and then chilled cooling water 140 around 14° C. The cooling water 142 and the chilled cooling water 140 are pumped to the mid- and top-section of the DCAC via pump 214 and 216, respectively. Chilled cooling water is produced in a nitrogen-water tower 4 by counter currently contacting cooling water with a nitrogen-enriched stream 137 produced in an air rectification unit 43, followed by warming up in the main heat exchangers. In FIG. 1, stream 137 primarily comes from a warmed first nitrogen-enriched stream 134, which is warmed in the low pressure heat exchanger 31 and has a temperature of 19.4° C. However, when the flow of stream 134 is not adequate, part of a warmed second nitrogen-enriched stream 135, which is warmed in the high pressure heat exchanger 32 and has a temperature of 35.7° C., may also be combined. Thus the nitrogen-enriched stream 137 entering into the nitrogen water tower is at a temperature around 21° C. After performing the cooling duty, stream 137 is discharged into air from the top of the nitrogen water tower.

After pre-cooling, the feed air stream now enters into the air purification unit 3 as stream 139 at a temperature of 17.0° C. The air purification unit 3 is a two-bed adsorption vessel that requires regeneration by nitrogen-enriched stream 138. Stream 138 is generated by heating a nitrogen-enriched stream 136 in a regeneration gas heater 201 to 150° C. Again, depending on the flow needed for regeneration, stream 136 can constitute only stream 135 from the high pressure heat exchanger, only stream 134 from the low pressure heat exchanger, or a combination of both. In this particular case, stream 136 is made of with a fraction of stream 135, and thus has the same temperature of 35.7° C.

The feed air stream leaving the air purification unit 3 at 25° C. is referred to as a main feed air stream 10. A part of it is introduced into the low pressure heat exchanger 31, undergoes indirect heat exchange with a first nitrogen-enriched stream 132, and optionally a gaseous nitrogen product 120 withdrawn from the top of a first column 40 operated at around 5-7 bara. Stream **10*a* then becomes a first feed air stream at ~25° C. and is fed into the bottom of the first column 40**.

Another part of stream 10 is passed through a booster air compressor 202 and its corresponding aftercooler to become a boosted pressure air stream 11 with a pressure of 42.5 bara and a temperature of 39° C. Part of stream 11 goes directly into the high pressure heat exchanger 32 and after partial cooling, is taken out as stream 14 to be delivered into a first expander 204. This expansion step provides refrigeration to the air rectification unit 43. Thereafter, the expanded and cooled stream 16 is combined into the first feed air stream 15. Another part of the boosted pressure air stream 11 is transported into a first compressor 203 to be further compressed to about 60~80 bara before being introduced into the high pressure heat exchanger as stream 12. Most commonly, the first expander 204 is a turbine expander, which constitutes a compression unit corresponds to the first compressor 203. Since stream 12 is now at an elevated pressure, it is capable of vaporizing pressurized liquid return streams in the high pressure heat exchanger. Thus return streams in the high pressure heat exchanger include generally a pumped oxygen liquid 102, sometimes a pumped nitrogen liquid 112 and the second nitrogen-enriched stream 133. Once stream 12 is cooled in the high pressure heat exchanger to become a third feed air stream 17, it is then expanded by a relief device such as a second expander 205 to form an expanded third feed air stream 18. Part of stream 18 enters directly into the first column 40 and part of it (**18*a*) is subcooled in a subcooler 33 before being fed into the second column 42**.

The feed air streams are rectified in the air rectification unit 43 to form an oxygen-enriched liquid stream 19 at the bottom and nitrogen overhead at the top of the first column 40. A fraction of the nitrogen overhead may be taken out of the first column 40 as a gaseous nitrogen product 120 with a pressure of around 5-7 bara. Stream 120 is warmed in the low pressure heat exchanger 31 and then sent to customer. The remaining nitrogen overhead is sent to a condenser evaporator 41 disposed at the bottom of the second column 42, wherein the nitrogen overhead is condensed against vaporizing oxygen liquid produced in the second column 42.

A part of the condensed nitrogen is withdrawn as a nitrogen liquid 110 followed by pumping in a nitrogen liquid pump 212 to form the pumped nitrogen liquid 112, while another part is returned to the first column 40 as reflux, yet another part 21 is subcooled in the subcooler 33 before become a liquid nitrogen product or sent to the second column 42 as reflux. Oxygen liquid produced at the bottom of the second column 42 is also withdrawn as an oxygen liquid 100 followed by pumping in an oxygen liquid pump 210 to form the pumped oxygen liquid 102. Both streams 102 and 112 are in the pressure range of around 5~90 bara and they are vaporized in the high pressure heat exchanger 32 to deliver pressurized gaseous oxygen and gaseous nitrogen products, respectively.

A nitrogen-enriched liquid stream 20, whose nitrogen content is usually around 95 mol %, is withdrawn from the mid-upper section of the first column 40. It is subcooled in the subcooler 33 and passed into the second column 42 as a reflux, where part of it is taken out as a nitrogen-enriched gaseous stream 130. This stream 130 is in some case referred to as a waste nitrogen stream. Since the second column 42 is normally operated in the pressure range of 1.1~1.5 bara, stream 130 is also at a pressure of around 1.1~1.5 bara. After being warmed up in the subcooler 33, stream 130 is divided into a first nitrogen-enriched stream 132, which then passes through the low pressure heat exchanger 31 and a second nitrogen-enriched stream 133, which then passes through the high pressure heat exchanger 32.

Since the first and second nitrogen-enriched streams 132 and 133 are divided from the same stream 130, they are at the same pressure on the cold side of the low and high pressure heat exchangers. On the warm side of the low and high pressure heat exchangers, in order to combine these two streams and direct them to different devices downstream as needed, the respective warmed first nitrogen-enriched stream 134 and warmed second nitrogen-enriched stream 135 are connected via a conjoint section. The conjoint section connects to the flow of stream 134 at a first connection point 400 and to the flow of stream 135 at a second connection point 402. The pressure at the connection point 400 and 402 needs to be adjustable to allow streams 134 and 135 to flow in either direction, enabling flexible distribution of streams 134 and 135 between the regeneration gas heater and the nitrogen water tower. In addition, the distribution between the first and second nitrogen-enriched streams 132 and 133 on the cold side of the low and high pressure heat exchangers may also be regulated by valves placed on the warm side of the heat exchangers.

In FIG. 1, an exemplary valve placement is described below. A first valve 301 is disposed between the second connection point 402 and the high pressure heat exchanger. A second valve 302 is disposed between the first connection point and a further entity, in this case, a nitrogen water tower. Because the pressure drop across a regulating valve is normally around 20 mbar, in order to keep the pressure at the first and second connection point identical, the pressure drop across the high pressure heat exchanger needs to be at least 20 mbar less than that across the low pressure heat exchanger. The valves are controlled by their respective flow indication controllers (FIC), which do not create much pressure drop by themselves; however, for energy saving reasons, they are usually not placed on the same stream as the valves being regulated. For instance, the first FIC for the first valve is placed on stream 134 and the second FIC for the second valve is placed next to the regeneration gas heater.

Assume that both the first valve and the second valve are adjusted to an initial position wherein the pressure at the first connection point 400 and the second connection point 402 are the same, the entire flow of 137 will be made up with stream 134 and the entire flow of 136 will be made up with stream 135. If more flow is desired for stream 137, then the first valve 301 will be closed off a little more, thus raising the pressure at 402 and causes part of stream 135 to go through the conjoint section and to be combined with stream 134. Likewise, if more flow is desired for stream 136, then the second valve 302 will be closed off a little more, thus raising the pressure at 400 and causes part of stream 134 to go through the conjoint section and to be combined with stream 135.

In some cases, the operation pressure of the entire rectification unit needs to be raised slightly to provide product at a desired pressure for the customer. This can be achieved by adding a third valve between the first connection point and the low pressure heat exchanger. It is in full open position when no pressure increase is needed and can be closed slightly to raise the operation pressure of the rectification unit. It can be controlled by a pressure indication controller (PICS) placed next to it.

A simulation is performed for an air separation unit according to the configuration of FIG. 1 having a capacity of oxygen at 70,000 $Nm^3/h$. The simulation is carried out with Hysys tool. Table 1 lists the simulated pressure, flowrate and temperature of selected flow streams.

TABLE 1

Simulated Properties of Selected Flows

| Flow # | Flow Description | Pressure bara | Flowrate $Nm^3/h$ | Temperature ° C. |
|---|---|---|---|---|
| 10 | Main feed air stream | 5.563 | 347,500 | 25 |
| 10a | Main feed air stream passing the low pressure heat exchanger | 5.563 | 163,900 | 25 |
| 11 | Boosted pressure air stream | 42.5 | 183,600 | 39 |
| 132 | First nitrogen-enriched stream | 1.243 | 129,930 | −176.3 |
| 133 | Second nitrogen-enriched stream | 1.243 | 86,918 | −176.3 |
| 134 | Warmed first nitrogen-enriched stream | 1.115 | 129,930 | 19.4 |
| 135 | Warmed second nitrogen-enriched stream | 1.135 | 86,918 | 35.7 |
| 136 | Nitrogen-enriched stream to the air purification unit | 1.105 | 70,900 | 35.7 |
| 137 | Nitrogen-enriched stream to the nitrogen water tower | 1.038 | 145,948 | 21 |

In the above table, it can be seen that the main feed air stream 10 after the pre-cooling and purification step is at 5.563 bara and 25° C. A fraction of stream 10 undergoes booster compression in a booster compressor and becomes stream 11 at 42.5 bara and 39° C. The remaining part of stream 10 and stream 11 enter into the low pressure heat exchanger and high pressure heat exchanger, respectively. Because of the temperature variance in the warm streams of these two heat exchangers, the cold streams are warmed up to different temperatures as they exit the separate heat exchangers. In this case, the first and second nitrogen-enriched streams are at the same pressure and temperature before entering the heat exchangers. After warming up against main feed air stream **10*a* in the low pressure heat exchanger, the warmed first nitrogen-enriched stream 134 ends up with a temperature of 19.4° C. In contrast, the warmed second nitrogen-enriched stream 135** passing through the high pressure heat exchanger ends up with a temperature of 35.7° C. due to indirect heat exchange with warmer flows including several boosted pressure streams.

Table 1 also demonstrates a scenario, wherein the stream 136 to the air purification unit does not require the entire flow of the warmed second nitrogen-enriched stream 135. Therefore, a part of stream 135 can supplement the warmed first nitrogen-enriched stream 134 to perform the cooling duty in the nitrogen water tower. This flow redistribution is achieved by slightly raising the pressure of stream 135 (1.135 bara) over stream 134 (1.115 bara) through the regulating valves. As a result, the combined stream 137 feeding into the nitrogen water tower has a temperature in between the warmed first and second nitrogen-enriched streams.

A comparative example is also simulated by only reversing the units that the warmed first and second nitrogen-enriched streams are being fed into, which is similar to arrangement disclosed in the prior art. Specifically, a cooler stream is introduced into the regeneration gas heater and a warmer stream is transported to the nitrogen water tower. The comparison with the inventive example of Table 1 is shown in Table 2.

TABLE 2

Simulated Flow and Equipment Properties

| Flow and Equipment Properties | Inventive Example | | | Comparative Example | | |
|---|---|---|---|---|---|---|
| | Pressure bara | Flowrate $Nm^3/h$ | Temp. ° C. | Pressure bara | Flowrate $Nm^3/h$ | Temp. ° C. |
| 136 nitrogen-enriched stream entering the regeneration gas heater | 1.105 | 70,900 | 35.7 | 1.105 | 90,000 | 26.0 |
| 138 nitrogen-enriched stream after the regeneration gas heater | 1.075 | 70,900 | 150 | 1.075 | 90,000 | 150 |
| 137 nitrogen-enriched stream entering the nitrogen water tower | 1.038 | 145,948 | 21 | 1.038 | 126,848 | 32 |
| 140 water chilled in the nitrogen water tower | — | 180 $m^3/h$ | 14 | — | 180 $m^3/h$ | 18 |
| 139 main feed air stream pre-cooled in the air cooler | 5.75 | 360,680 | 17.0 | 5.75 | 360,680 | 21.0 |
| 10 main feed air stream after the adsorber vessel | 5.7 | 360,680 | 25.0 | 5.7 | 360,680 | 32.0 |
| Steam consumed by the regeneration gas heater 201 | | base | | | Base + 10% | |
| Diameter of a single vessel in the air purification unit 3 | | 4.9 m | | | 5.2 m | |
| Adsorbents volume used in the air purification unit 3 | | base | | | Base + 15% | |
| Power consumed by the booster air compressor 202 | | 15,500 | | | 15,600 | |

In the examples of Table 2, the regeneration gas heater 201 driven by low pressure steam is used to heat incoming nitrogen-enriched stream to a temperature of 150° C. suitable for regeneration. When the incoming nitrogen-enriched stream is at a higher temperature, the steam consumed for heating is less. This incoming nitrogen-enriched stream is at 35.7° C. in the inventive example vs. 26.0° C. in the comparative example; as a result, the regeneration gas heater in the comparative example consumes 10% more steam by flowrate.

The nitrogen-enriched stream being fed into the nitrogen water tower is also at a lower temperature of 21° C. in the inventive example than the temperature of 32° C. in the comparative example. A cooler nitrogen-enriched stream leads to a colder water stream 140 chilled in the nitrogen water tower, which in turn leads to a colder main feed air stream 139 exiting the air pre-cooling unit in the inventive example. Because a colder air stream contains less water, the amount of adsorbents, such as alumina used for removing water is reduced. In addition, adsorption efficiency is higher at lower temperature for other major impurities including $CO_2$, thus its specific adsorbent, such as molecular sieves, can also be used in less quantity. According to the simulation, to treat the same flowrate of main feed air stream, the comparative example requires 15% more adsorbents by volume. The diameter of the adsorption vessel relates to the volume of the adsorbents encased, and the inventive example has a smaller diameter of 4.9 m vs. 5.2 m for the comparative example.

A feed air stream, which enters into the air purification unit at a lower temperature, also exits the unit at a lower temperature. Part of the stream is then further compressed in the booster air compressor. Due to the fact that the booster air compressor is more energy efficient for colder incoming stream, the power consumed in the inventive example is less than that of the comparative example.

From the foregoing description, one skilled in the art can easily ascertain the essential characteristics of this invention and, without departing from the spirit and scope thereof, can make various changes and modifications of the invention to adapt it to various usages and conditions.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process of separating air comprising:

a) passing a feed air stream sequentially through a main air compressor, an air pre-cooling unit and an air purification unit to produce a main feed air stream, further compressing part of the main feed air stream in a booster air compressor to form a boosted pressure air stream having a higher pressure and a higher temperature than the main feed air stream;

b) cooling another part of the main feed air stream in a low-pressure heat exchanger through indirect heat exchange with a first nitrogen-enriched stream produced in an air rectification unit comprising a first column, a second column and a condenser evaporator disposed at a bottom of the second column, wherein the first column is operated at a higher pressure than the second column, thereby producing a first feed air stream for feeding into the air rectification unit;

c) partially cooling at least part of the boosted pressure air stream in a high-pressure heat exchanger through indirect heat exchange with a pumped oxygen liquid and a second nitrogen-enriched stream produced in the air rectification unit, followed by expansion in a first expander before feeding into the air rectification unit as a second feed air stream;

d) cooling a second part of the boosted pressure air stream in the high-pressure heat exchanger through indirect heat exchange with the pumped oxygen liquid and the second nitrogen-enriched stream to produce a third feed air stream, followed by expansion in a second expander to produce an expanded third feed air stream for feeding into the air rectification unit;

e) introducing a warmed second nitrogen-enriched stream formed after passing the second nitrogen-enriched stream through the high-pressure heat exchanger into a regeneration gas heater and the air purification unit for regeneration and introducing a warmed first nitrogen-enriched stream formed after passing the first nitrogen-enriched stream through the low-pressure heat exchanger into a further entity;

wherein the warmed first nitrogen-enriched stream and the warmed second nitrogen-enriched stream are in flow communication and the warmed second nitrogen-enriched stream is of a higher temperature compared to the warmed first nitrogen-enriched stream, wherein the warmed first nitrogen-enriched stream and the warmed second nitrogen-enriched stream are in flow communication through a conjoint section, wherein the conjoint section intersects with a flow of the warmed first nitrogen-enriched stream at a first connection point disposed between the low-pressure heat exchanger and the further entity and interconnects with a flow of the warmed second nitrogen-enriched stream at a second connection point disposed between the high-pressure heat exchanger and the regeneration gas heater, wherein an operating pressure of the air rectification unit may be adjusted through a third valve, which is controlled by a third pressure indication controller, wherein the third valve and the third pressure indication controller are disposed between the low-pressure heat exchanger and the first connection point.

2. The process as claimed in claim 1, wherein the first and the second nitrogen-enriched streams are divided from a same nitrogen-enriched gaseous stream withdrawn from the second column.

3. The process as claimed in claim 1, wherein the warmed second nitrogen-enriched stream is 2 to 20° C. warmer than the warmed first nitrogen-enriched stream.

4. The process as claimed in claim 3, wherein the warmed second nitrogen-enriched stream is 10° C. warmer than the warmed first nitrogen-enriched stream.

5. The process as claimed in claim 1, wherein the further entity comprises a nitrogen water tower.

6. The process as claimed in claim 1, wherein the air pre-cooling unit comprises an air cooler and nitrogen water tower.

7. The process as claimed in claim 1, wherein part of the warmed first nitrogen-enriched stream is introduced into the air purification unit for regeneration through the conjoint section.

8. The process as claimed in claim 1, wherein part of the warmed second nitrogen-enriched stream is combined with the warmed first nitrogen-enriched stream through the conjoint section before being fed into the further entity.

9. The process as claimed in claim 1, wherein a flow balance of the first nitrogen-enriched stream to the second nitrogen-enriched stream is regulated by a first valve disposed between the high-pressure heat exchanger and the second connection point.

10. A process of separating air comprising:

a) passing a feed air stream sequentially through a main air compressor, an air pre-cooling unit and an air purification unit to produce a main feed air stream, further compressing part of the main feed air stream in a booster air compressor to form a boosted pressure air stream having a higher pressure and a higher temperature than the main feed air stream;

b) cooling another part of the main feed air stream in a low-pressure heat exchanger through indirect heat exchange with a first nitrogen-enriched stream produced in an air rectification unit comprising a first column, a second column and a condenser evaporator disposed at a bottom of the second column, wherein the first column is operated at a higher pressure than the second column, thereby producing a first feed air stream for feeding into the air rectification unit;

c) partially cooling at least part of the boosted pressure air stream in a high-pressure heat exchanger through indirect heat exchange with a pumped oxygen liquid and a second nitrogen-enriched stream produced in the air rectification unit, followed by expansion in a first expander before feeding into the air rectification unit as a second feed air stream;

d) cooling a second part of the boosted pressure air stream in the high-pressure heat exchanger through indirect heat exchange with the pumped oxygen liquid and the second nitrogen-enriched stream to produce a third feed air stream, followed by expansion in a second expander to produce an expanded third feed air stream for feeding into the air rectification unit;

e) introducing a warmed second nitrogen-enriched stream formed after passing the second nitrogen-enriched stream through the high-pressure heat exchanger into a regeneration gas heater and the air purification unit for regeneration and introducing a warmed first nitrogen-enriched stream formed after passing the first nitrogen-enriched stream through the low-pressure heat exchanger into a further entity;

wherein the warmed first nitrogen-enriched stream and the warmed second nitrogen-enriched stream are in flow communication and the warmed second nitrogen-enriched stream is of a higher temperature compared to the warmed first nitrogen-enriched stream, wherein the warmed first nitrogen-enriched stream and the warmed second nitrogen-enriched stream are in flow communication through a conjoint section, wherein the conjoint section intersects with a flow of the warmed first nitrogen-enriched stream at a first connection point disposed between the low-pressure heat exchanger and the further entity and interconnects with a flow of the warmed second nitrogen-enriched stream at a second connection point disposed between the high-pressure heat exchanger and the regeneration gas heater, wherein a flow balance of the first nitrogen-enriched stream to the second nitrogen-enriched stream is regulated by a first valve disposed between the high-pressure heat exchanger and the second connection point, wherein the first valve is controlled by a first flow indication controller disposed between the low-pressure heat exchanger and the first connection point.

11. The process as claimed in claim 1, wherein a flow to the further entity is regulated by a second valve disposed between the first connection point and the further entity.

12. A process of separating air comprising:

a) passing a feed air stream sequentially through a main air compressor, an air pre-cooling unit and an air purification unit to produce a main feed air stream, further compressing part of the main feed air stream in a booster air compressor to form a boosted pressure air stream having a higher pressure and a higher temperature than the main feed air stream;

b) cooling another part of the main feed air stream in a low-pressure heat exchanger through indirect heat exchange with a first nitrogen-enriched stream produced in an air rectification unit comprising a first column, a second column and a condenser evaporator disposed at a bottom of the second column, wherein the first column is operated at a higher pressure than the second column, thereby producing a first feed air stream for feeding into the air rectification unit;

c) partially cooling at least part of the boosted pressure air stream in a high-pressure heat exchanger through indirect heat exchange with a pumped oxygen liquid and a second nitrogen-enriched stream produced in the air rectification unit, followed by expansion in a first expander before feeding into the air rectification unit as a second feed air stream;

d) cooling a second part of the boosted pressure air stream in the high-pressure heat exchanger through indirect heat exchange with the pumped oxygen liquid and the second nitrogen-enriched stream to produce a third feed air stream, followed by expansion in a second expander to produce an expanded third feed air stream for feeding into the air rectification unit;

e) introducing a warmed second nitrogen-enriched stream formed after passing the second nitrogen-enriched stream through the high-pressure heat exchanger into a regeneration gas heater and the air purification unit for regeneration and introducing a warmed first nitrogen-enriched stream formed after passing the first nitrogen-enriched stream through the low-pressure heat exchanger into a further entity;

wherein the warmed first nitrogen-enriched stream and the warmed second nitrogen enriched stream are in flow communication and the warmed second nitrogen-enriched stream is of a higher temperature compared to the warmed first nitrogen-enriched stream, wherein the warmed first nitrogen-enriched stream and the warmed second nitrogen-enriched stream are in flow communication through a conjoint section, wherein the conjoint section intersects with a flow of the warmed first nitrogen-enriched stream at a first connection point disposed between the low-pressure heat exchanger and the further entity and interconnects with a flow of the warmed second nitrogen-enriched stream at a second connection point disposed between the high-pressure heat exchanger and the regeneration gas heater, wherein a flow to the further entity is regulated by a second valve disposed between the first connection point and the further entity, wherein the second valve is controlled by a second flow indication controller disposed between the second connection point and the regenerated gas heater.

13. The process as claimed in claim 1, wherein a pressure drop across the passage for the second nitrogen-enriched stream in the high-pressure heat exchanger is at least 20 mbar less than that across a passage for the first nitrogen-enriched stream in the low-pressure heat exchanger.

14. The process as claimed in claim 1, wherein the boosted pressure air stream is cooled also through indirect heat exchange with a pumped nitrogen liquid in the high-pressure heat exchanger.

15. The process as claimed in claim 1, wherein the main feed air stream is cooled also through indirect heat exchange with a gaseous nitrogen product in the low-pressure heat exchanger.

* * * * *